United States Patent [19]

Moraw et al.

[11] Patent Number: 4,462,675

[45] Date of Patent: Jul. 31, 1984

[54] PROCESS AND APPARATUS FOR THERMALLY FIXING TONER IMAGES

[75] Inventors: Roland Moraw; Günther Schaedlich, both of Wiesbaden, Fed. Rep. of Germany

[73] Assignee: Hoechst Aktiengesellschaft, Frankfurt am Main, Fed. Rep. of Germany

[21] Appl. No.: 324,150

[22] Filed: Nov. 23, 1981

[30] Foreign Application Priority Data

Dec. 3, 1980 [DE] Fed. Rep. of Germany ..... 3045485

[51] Int. Cl.[3] ..... G03G 15/00

[52] U.S. Cl. ..... 355/3 R; 34/73; 355/10

[58] Field of Search ..... 355/3 R, 10, 77, 15; 430/97; 34/73, 77, 155

[56] References Cited

U.S. PATENT DOCUMENTS

| | | | |
|---|---|---|---|
| 3,854,224 | 12/1974 | Yamaji et al. | 355/10 X |
| 3,880,515 | 4/1975 | Tanaka et al. | 355/10 |
| 3,997,977 | 12/1976 | Katayama et al. | 34/73 |
| 4,086,705 | 5/1978 | Wehr | 34/73 X |

FOREIGN PATENT DOCUMENTS

| | | | |
|---|---|---|---|
| 972948 | 8/1975 | Canada | 355/10 |
| 2363976 | 6/1974 | Fed. Rep. of Germany | 355/10 |
| 2365783 | 4/1976 | Fed. Rep. of Germany | 355/10 |
| 1966591 | 5/1978 | Fed. Rep. of Germany . | |

OTHER PUBLICATIONS

Patent Abstract, vol. 4, No. 86 (P-16) [568] Jun. 20, 1980, 149 P 16 and 150 P 16.

*Primary Examiner*—R. L. Moses

*Attorney, Agent, or Firm*—Schwartz, Jeffery, Schwaab, Mack, Blumenthal & Koch

[57] ABSTRACT

A process is disclosed for thermally fixing on a support a latent electrostatic image which has been rendered visible by means of a suspension developer by applying heat and vaporizing the developing liquid, in which process the evaporating developing liquid is sucked off, condensed, separated and collected.

8 Claims, 10 Drawing Figures

PROCESS AND APPARATUS FOR THERMALLY FIXING TONER IMAGES

BACKGROUND OF THE INVENTION

1. Field of the Invention

The present invention relates to a process for thermally fixing a latent electrostatic image which has been rendered visible by means of a suspension developer on a support by applying heat and vaporizing the developing liquid. The invention also relates to an apparatus which is suitable for carrying out the process.

2. Discussion of Related Art

Thermal fixing is generally applied to latent electrostatic images which have been rendered visible. These so-called toner images, which are generated by liquid development of charge images of various origin, are, for example, produced in electrostatic printers with the aid of recording electrodes, by electron beam recording, X-ray recording in ionization chambers or, as widely used, by charging and exposing photoconductive layers. Processes are known in which the toner image prepared is, for example, fixed on a photoconductive layer, as in the case of zinc-oxide coated papers or electrophotographic printing plates, or in which the toner image is transferred from an original support, for example, a photoconductive layer, to a copy support, consisting of paper or film, on which it is then fixed. Many conventional office copiers use the last-mentioned principle. Thermal fixing which is equivalent to drying moist copies is, for example, also employed under ecologically acceptable conditions in the so-called ink-jet recording, where an ink jet which is controlled and modulated according to the information received, is directed to a support.

The electrophotographic copying technology used in office copiers has today gained great importance and has become the preferred, although not the exclusive field of application for thermal fixing. Without intending to limit the present invention, the description of the invention is, therefore, based on this technology.

The essential component in known electrophotographic office copiers run with liquid development, is the photoconductive medium which has the form of a plate, a web or, usually a drum. In the present case, the specific construction of the photoconductive medium comprising organic or inorganic materials or one or several optionally insulating layers is not significant. Generally, the photoconductive layer is first electrostatically charged by a corona and then imagewise exposed. By applying a pigmented powder, a so-called dry toner, or a liquid toner the resulting latent electrostatic image is rendered visible, for example, with the aid of a developing electrode. Usually, the suspension developer is composed of a dispersing liquid, preferably an aliphatic hydrocarbon, and various additions, among others a finely divided charged pigment. In most copiers, the layer thickness of the liquid developer on the photoconductor is reduced, for example, by a metering roll or by spraying-on corona charges. For transferring the toner image from the photoconductor to the copy support, for example paper, the copy support is moved to the photoconductor and to assist transfer electrostatically, the copy support is charged by a corona on the reverse side. In the transfer procedure, the copy support picks up pigment in imagewise distribution and, over its entire surface, also a large portion of the dispersing liquid. Only after evaporation of the developing liquid, will the toner image become fast and resist wiping. To make the toner image fast, the copy is warmed up, for example, by means of a heater plate. By a stream of air from a fan which is mounted in a suitable position in the copier and which, for example, also serves to cool the exposure lamps, the vaporized developing liquid is expelled through slots provided in the copier housing. The dried copy is then placed on a platform. Before the next copying cycle, the photoconductive surface is freed from any toner and liquid residue and from residual charges, for example, with the aid of a foam plastic roller equipped with an elastic wiper and by the action of an AC corona.

It is a disadvantage of the above-described copying technique run with liquid development that the developing liquid vaporized from the copy is discharged to the environment. Although the developing liquid, for example, an aliphatic hydrocarbon, is not toxic as such, the emission of vaporized liquid to the surroundings, nevertheless, causes an undesirable burden on the environment.

SUMMARY OF THE INVENTION

It is therefore an object of the present invention to provide, within the scope of the production of copies by electrophotographic or electrographic means using liquid development, a process for fixing the toner image, which prevents or reduces the discharge of developing liquid from a suspension developer and thus renders the copying technique which uses suspension developers environmentally safe to a higher degree.

The invention is based on a process of the above-described kind and is characterized in that the evaporating developing liquid is drawn off by suction, condensed, separated and collected. In a preferred embodiment of the invention, drawing off by suction is effected in the area of heat supply and downstream of this area, as viewed in the direction of motion. Advantageously, the air stream used for sucking off is reused after separation of the vaporized liquid.

Accordingly, the developing liquid which has been vaporized from the copy can be sucked off through inner vents in the heating area and outer vents downstream of the heating area, in the direction of motion of the copy. The exhausted vapor can be condensed and separated in a down pipe, immediately behind the vents, preferably by generating a fog and electrostatically filtering it. It is also possible to precipitate the vaporized liquid with the aid of a finely divided transport medium, for example, atomized water or water vapor. To increase efficiency, developing liquids having coefficients of evaporation exceeding about 70 (ether=1) may be used.

BRIEF DESCRIPTION OF THE DRAWINGS

Below, the invention is described in more detail by reference to the accompanying drawings in which.

DETAILED DESCRIPTION OF THE PREFERRED EMBODIMENTS

Figure 1:
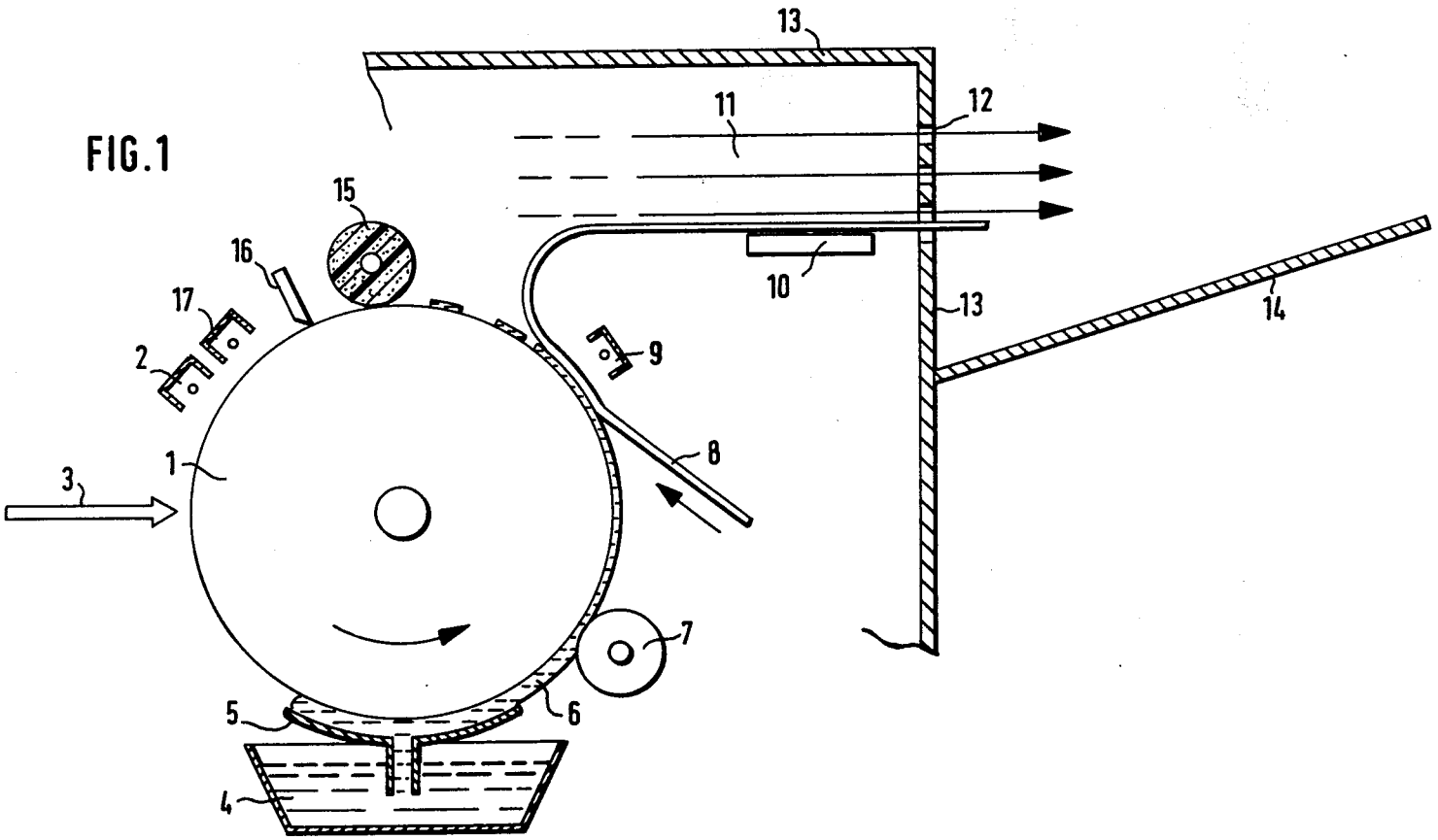
FIG. 1 is a diagrammatical view showing the operation of a known copier.

FIG. 1 shows, in a copying cycle described by way of example, a photoconductor drum 1, a charging corona 2, exposure in image configuration 3, a suspension developer 4, a developing electrode 5 and a layer of developing liquid 6, a metering roller 7 and a copy support 8. In addition, FIG. 1 depicts a transfer corona 9, a heater plate 10 together with a prevailing air stream 11 which, for example, leaves the housing 13 through slots 12, and a receiving platform 14. A foam plastic roller 15 and a wiper blade 16 serve to clean the photoconductive surface from any toner residue and AC corona 17 is used to free the photoconductive surface from residual charges.

Figure 2:
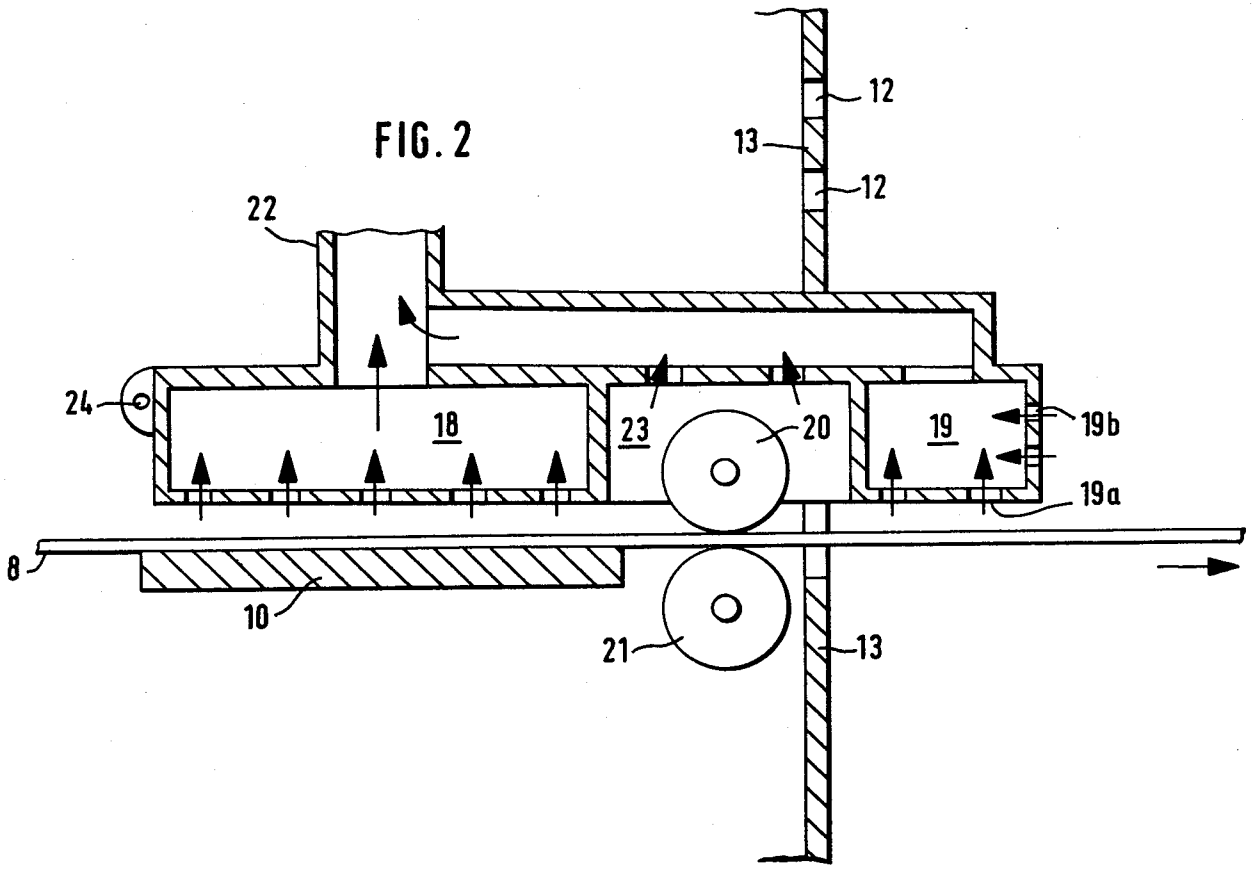
FIG. 2 shows a vent arrangement according to the present invention.
Figure 3:
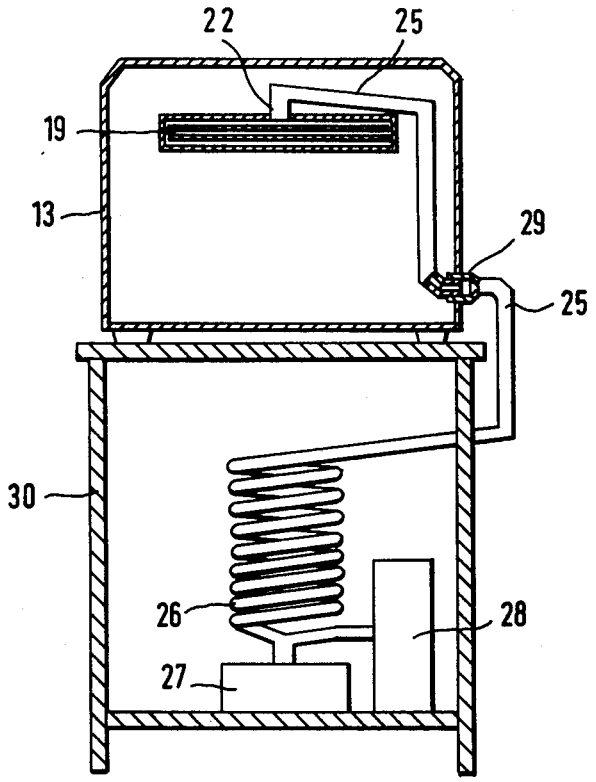
FIG. 3 shows a condensing, separating and collecting apparatus according to the present invention.

The present invention is a method and apparatus for thermally fixing a latent electrostatic image which has been rendered visible by means of a suspension developer. In the apparatus as shown in FIGS. 2 and 3, at least one vent system 18 is installed in the fixing area (heater plate 10), through which the evaporating liquid is sucked off and, downstream thereof, arrangements are provided for condensing 25, 26 and separating and collecting 27 the liquid. For sucking off the evaporating developing liquid, the apparatus of the invention preferably has an inner vent system 18 in the area of heat supply and an outer vent system 19 which is arranged downstream of the heating area in the discharge area of the copy support 8 and the vents **19*a* and 19*b***, which preferably face in two directions.

The apparatus of FIG. 2 includes an inner vent system 18 above a heater plate 10, i.e. in the area of heat supply, and an outer vent system 19, downstream of the heater plate 10 and optionally also downstream of the discharge slot formed by discharge rollers 20 and 21 and outside of the wall of the housing 13. The major portion of the developing liquid evaporates only after the copy support 8 is fully heated and this condition is reached when the copy is in the second half of the fixing area (heater plate 10), as viewed in the direction of transport. A considerable amount of developing liquid, however, is still vaporized from the heated-up copy support, when the latter has already left the heater plate 10 and, therefore, an additional outer vent system 19 is required. In the case of vent openings which point in the downward direction only, the outer vent system must project far beyond the discharge slot and over the receiving platform 14. In the production of copies, such an arrangement is considered inconvenient, because it hinders viewing of the copies. It has now been found that the outer vent system can advantageously be constructed in a very compact manner and without substantially hiding the discharged copies from view, if the downwardly directed vent openings **19*a* are complemented by vent openings 19*b* in the housing front. Thus an outer vent system 19 which, for example, projects only a few centimeters over the wall of the housing 13 yields a positive effect. The vaporized and sucked off developing liquid is carried off via at least one suction nozzle 22. FIG. 2 does not show the side walls of the vent systems, which extend downwardly, close to the copy support 8 and optionally even further down, past the copy support 8 and the heater plate 10**. The arrangement for heating the moist copy is diagrammatically shown as a planar heater plate. In customary copiers, the heater plates are sometimes curved to obtain an improved counter pressure or heated rollers are used. It is then necessary to have a correspondingly curved or concave inner vent system.

If the heater plate 10 is additionally provided with pressure rollers, the latter must be built corresondingly small so that it is possible to fit them below the inner vent system 18. These rollers can then be enclosed by a vent chamber, similar to the vent chamber 23 shown in FIG. 2, which encloses the upper discharge roller 20 (with appertaining counter roller 21). If necessary, further component parts which enhance evaporation, such as radiators, can be incorporated in the vent systems. It has, furthermore, proved advantageous to pivot the vent systems on a hinge 24. Any transport obstructions occurring in the heating area are easily and quickly removable, if the vent systems can be opened up on their hinge 24.

A vent system according to FIG. 2 was practically tested in a conventional electrophotographic copier. If the heating is switched off and no suction is applied, a weight increase of the copies due to absorbed developing liquid of 0.11 g is determined for each DIN A4 size copy. As the developing liquid, an aliphatic hydrocarbon having a boiling range from about 155° to 180° C. and a coefficient of evaporation of about 36 is used. The heating is then switched on and the evaporating hydrocarbon is carried off by suction in a quantity of 0.2 $m^3$/minute and the mixture of vapor and air is passed through a cooling trap. The weight increase of the cooling trap amounts to 0.09 g per DIN A4 size copy, which corresponds to an efficiency of suction of 82%. For an aliphatic hydrocarbon which has a boiling range from about 180° to 210° C. and a coefficient of evaporation of about 150, used as the dispersing agent, the corresponding values are 0.13 g per DIN A4 size copy or 0.12 g per DIN A4 size copy, respectively, which corresponds to an efficiency of suction of 92%. Such a result is, however, only obtainable, if the aliphatic hydrocarbon is freed by distillation from any lower boiling constituents. With a higher coefficient of evaporation of the developing liquid, secondary losses due to evaporation from the cooling trap are found to be lower and the efficiency of suction which can be calculated from this measured value is higher. Without the outer vent system 19, efficiencies are by about 25% lower.

From the mixture of air and vapor which is sucked off at a corresponding suction force, the developing liquid is separated and collected. For this purpose, the air/vapor mixture is passed through a tube which is optionally cooled and in which the vapor is condensed on the tubing walls. Immediately behind the suction nozzle 22 (FIG. 3), the air/vapor mixture enters into a pipe 25 which is, if possible, downwardly inclined and prevents any return flow; through this pipe, the mixture is conveyed to the condenser system. To enable an efficiency of vapor condensation of about 90%, a tube coil of good heat-conducting properties is necessary and can be, for example, made of copper. In a tube which has a length of about 10 m and a diameter of 2 cm, no cooling liquid is required, instead it is possible to cool with ambient air. Since the tube coil is provided with cooling surfaces, for example, in the form of interspaces between the individual turns of the coil, it occupies a relatively large volume of about 15 liters.

It is, thus, normally too large for installation in a copier. The tube coil serving as the condenser means 26, together with a collecting vessel 27 for the condensed developing liquid and a pneumatic pump 28, are therefore appropriately constructed as an accessory which is connected to the copier via a flange 29. As shown in FIG. 3, such an accessory is, for example, advantageously placed on the lower shelf of a table 30 which is used as a support for the copier housing 13.

High efficiencies of the condenser means can, particularly, be obtained, if the developing liquids used have high coefficients of evaporation of up to more than 600. In an aliphatic hydrocarbon which has a boiling range of about 180° C. and a coefficient of evaporation of about 60 or in an aliphatic hydrocarbon which has a coefficient of evaporation of about 30, approximately 70% and 60%, respectively, of the vaporized developing liquid are recovered by condensation.

Figure 4:
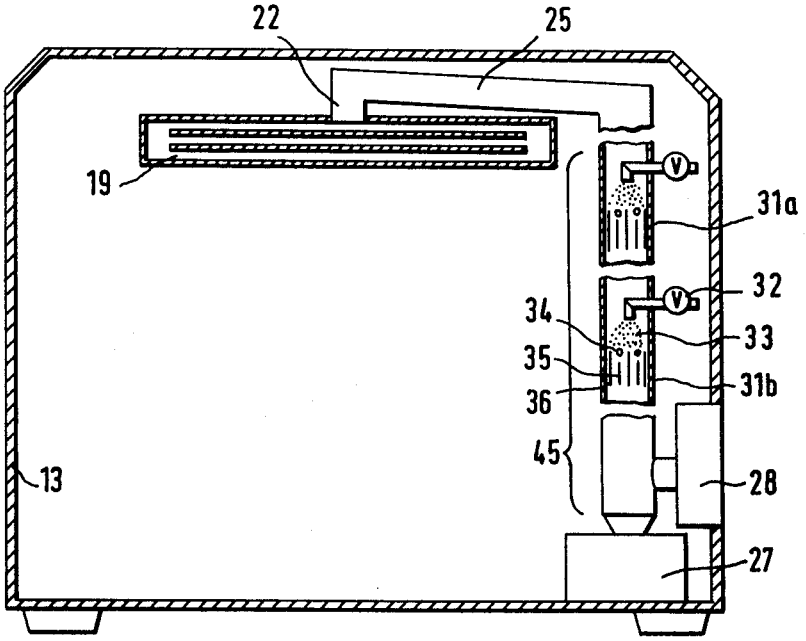
FIG. 4 shows an alternate embodiment of a condensing, separating and collecting apparatus according to the present invention.

By turning the vaporized developing liquid into fog and separating this fog by means of electrostatic filters, it is possible advantageously to reduce the volume required for condensation to such an extent that a corresponding system can even be installed in a copier. A preferred embodiment of such a system is shown in FIG. 4.

The warm mixture of air and vaporized liquid is conducted over the shortest possible distance through the inclined down pipe 25 into the separator 45, which comprises at least one electrostatic filtering unit 31*a*. It is possible to have one filtering unit or several units arranged in sequence (as marked by reference numerals 31*a* and 31*b* in FIG. 4). Through a tube provided with a valve 32 or through a nozzle scroll, optionally precooled air is supplied from the environment to the warm mixture. In the undercooled mixture, fog 33 consisting of droplets of the developing liquid is immediately produced. This fog disappears in the area of the electrostatic filter constructed of corona wires 34 and grounded separating electrodes 35 and 36. Without application of a voltage, for example, of about 5 to 6 kV, to the corona wires, the fog persists for a length of a couple of decimeters within the flowing mixture.

Figure 5:
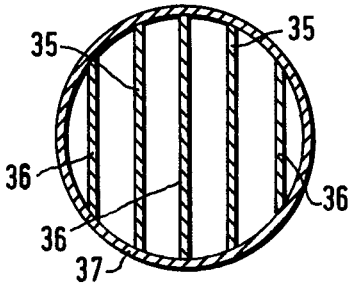
FIG. 5 is a cross-sectional plan view of the construction of an electrostatic filter used in the present invention.
Figure 6:
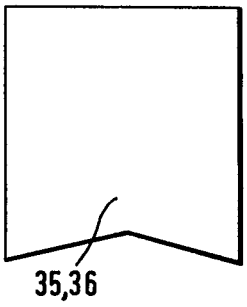
FIG. 6 shows one of the plate electrodes of the filter of FIG. 5.
Figure 7:
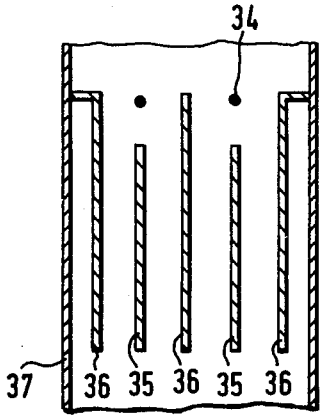
FIG. 7 is an elevational cross-section of the plate electrodes of FIG. 5.

The construction of electrostatic filters is known in the art. In the present case, the tubes 37 used in the separating systems are made of glass, among others for the purpose of observing the process, and they have a diameter of about 4 cm (FIGS. 5 and 7). The pipes are fitted with metallic plate electrodes 35 and 36, spaced approximately 7 mm. As shown in FIG. 6, the plate electrodes 35 and 36 have recesses at their lower ends so that any separated developing liquid can flow more easily to the tube walls. The plate electrodes have different lengths of about 4.5 cm for electrodes 36 and about 3.5 cm for electrodes 35 (see FIG. 7). The corona wires 34 are arranged above the shorter plate electrodes 35. A complete electrostatic filter 31 used as a separating system has a height of about 8 cm. The separating systems are connected with a collecting vessel 27 for the separated developing liquid. Upstream of the collecting vessel, the aspirated air is carried off laterally through a pneumatic pump 28.

There is a correlation between the efficiency of the electrostatic filtering system and the developing liquid used in the liquid developer. In the case of a very highly boiling developing liquid, for example, an aliphatic hydrocarbon which has a boiling range between about 200° C. and 260° C., fog generation is very strong. Without the use of an electrostatic filter, this fog is visible for several seconds. In the aforedescribed arrangement, separation has an efficiency of about 90%. It is then possible to have one separating stage only. If an aliphatic hydrocarbon which has a boiling range between about 190° C. and 240° C. is used as the developing liquid, similarly good results are obtained, if two separating stages are employed. For lower-boiling developing liquids, the efficiency of separation decreases correspondingly. However, efficiencies can be markedly raised in such lower-boiling developing liquids, if instead of air at room temperature of about 23° C., cold air, for example, outside air is blown in through the valves 32.

Figure 8:
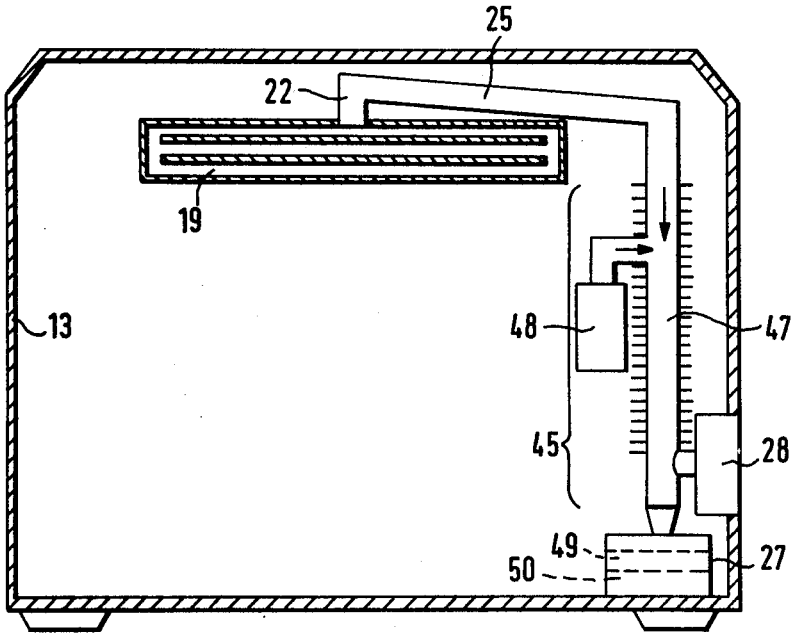
FIG. 8 shows another alternate embodiment of a condensing, separating and collecting apparatus according to the present invention.

In a further embodiment of the invention, the vapor of the dispersing agent is precipitated with the aid of a finely divided transport medium, preferably a non-miscible liquid, for example, water or a glycol. An arrangement of this kind is shown in FIG. 8. Here, finely divided water is sprayed from a spray device 48 into the mixture of air and vaporized developing liquid, which leaves the down pipe 25. The term "finely divided water" denotes water vapor and also sprayed, i.e. atomized, water. Accordingly, the spray device 48 comprises either a vaporizer or an atomizer equipped with a nozzle. The mixture of finely divided transport medium and vaporized developing liquid condenses very readily so that it is even possible to run the condensing tube 47 with air cooling. In the collecting vessel 27, the developing liquid is separated to form, for example, an upper layer 49, while the transport medium forms a lower layer 50. The transport medium can be drained from the bottom of the collecting vessel 27 and is again introduced in the cycle (not shown) of the spray device 48.

In vapor generation and also in atomizing, about five parts by volume of transport liquid are required to separate one part by volume of developing liquid at an efficiency of about 95%. At a volume ratio of 2:1, the efficiency achieved is still about 65%. It is further a great advantage of this process that even developing liquids which have relatively low coefficients of evaporation of about 35 yield such good efficiencies upon separation.

In a generally advantageous embodiment, the mixture of air and vaporized developing liquid is passed through a separator 45 and is then recycled to the suction device. It is a particular advantage of this cycle arrangement that, in the separator 45, only the major portion of the vaporized developing liquid must be separated, since the air depleted of vapor will again take up additional vapor, even if a certain residual content is still present.

Figure 9:
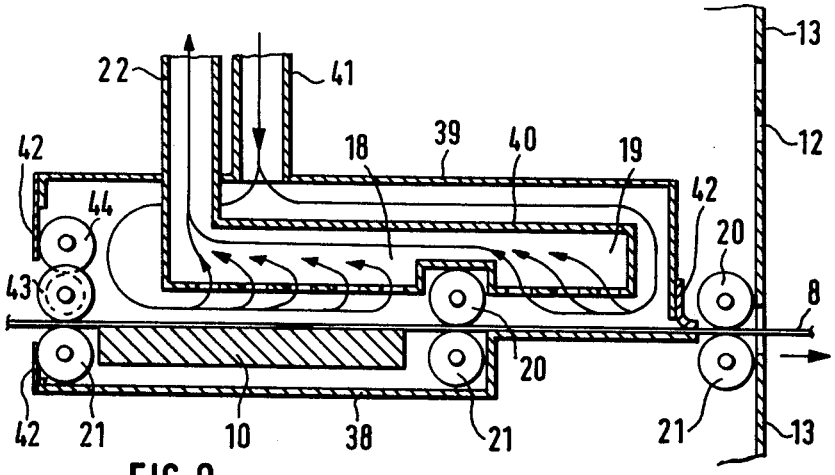
FIG. 9 shows the air flow circulation in a recirculating vent according to the present invention.

A suction device in which the air stream is circulated is shown in FIG. 9. The suction device comprises an inner vent system 18 above the heater plate 10 and an outer vent system 19. At least at the inlet of the copy sheet, preferably at the outlet of the copy sheet and optionally in both positions, the circulated air is introduced through a nozzle 41 and through a channel made up of an upper wall 39 and an intermediate wall 40. This arrangement is preferably closed by a lower bottom plate 38. Seals which comprise a flexible material, for example, spring plates 42, protect the inlet and outlet slots for the copy sheets. To prevent any blurring of the still damp toner image, the inlet slot is formed by a pair of rollers, in which the upper transport roller 43 facing the toner image, has a knurled surface, i.e. a pointed surface structure. The points on the surface of the roller 43 are pressed into an elastic sealing roller 44.

Figure 10:
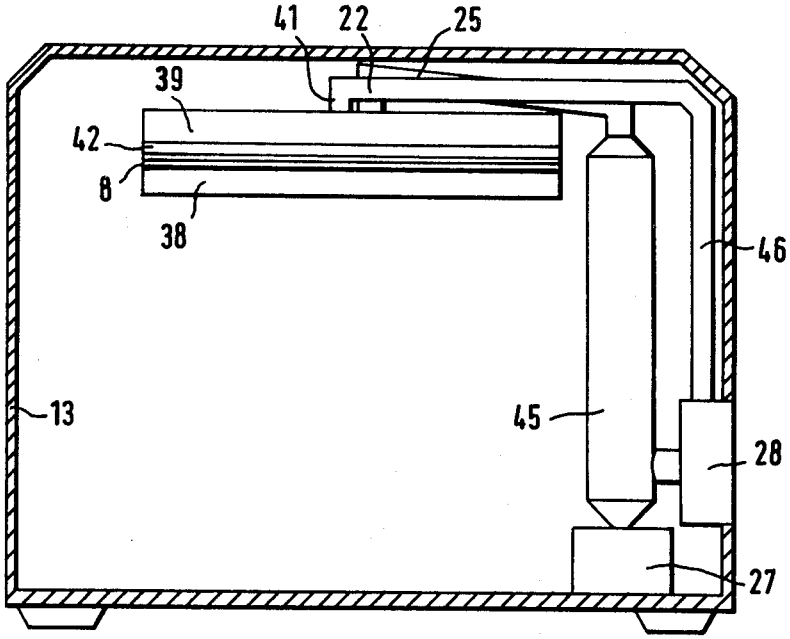
FIG. 10 shows the cycle arrangement in an air recirculation system according to the present invention.

The actual cycle arrangement is shown in FIG. 10. The mixture of air and vaporized developing liquid enters into the inclined pipe 25 through the nozzle 22 and is, from the pipe, conveyed to the separator 45, in which the proportion of developing liquid is separated from the mixture, by cooling, fog generation, precipitation by means of a finely divided transport medium or according to any other separating technique. The air which has been depleted of vaporized developing liquid is again returned to the suction device, via the air supply pipe 46 and the nozzle 41.

The higher the efficiency of operation of the separator 45, the more compact and small the apparatus may be constructed so that, finally, the suction and separating systems form one unit without any special connecting lines.

The above description is considered illustrative of the invention but is not deemed to limit the scope thereof. Obviously, numerous additions, modifications, and changes may be made in the invention without departing from the scope thereof as set forth in the appended claims.

What is claimed is:

1. An apparatus for thermally fixing a latent electrostatic image which has been rendered visible by a liquid suspension developer, comprising:

a heater;

a support for said image;

means for moving said support past said heater thereby vaporizing the developing liquid;

two vent systems arranged as an inner vent system disposed in the area of said heater and as an outer vent system disposed downstream of said heater in the discharge area of the copy support for sucking off said vaporized developing liquid in an air stream; and means connected to said vent systems for condensing said vaporized liquid, including a spray device for spraying a finely divided transport medium into said vaporized liquid and a condenser tube positioned downstream of said spray device, and separating and collecting said condensed liquid.

2. The apparatus according to claim 1, wherein said outer vent includes vent openings disposed in at least two planes.

3. The apparatus according to claim 2, wherein said two planes are disposed perpendicular to each other.

4. The apparatus according to claim 1 and further including means for recirculating said air stream after said developing liquid is separated.

5. The apparatus according to claim 1, wherein said spray device comprises a device for producing vaporized water.

6. The apparatus according to claim 1, wherein said spray device comprises a device for producing atomized water.

7. The apparatus according to claim 1, wherein said condensor tube comprises an air-cooled condenser tube.

8. The apparatus according to claim 1, wherein said transport medium comprises a liquid non-miscible with said developing liquid, and said apparatus further comprises a collecting vessel at the outlet of said condenser tube, said collecting vessel comprising means for separating the condensed developing liquid from the transport medium based upon layer separation of said non-miscible liquids.

* * * * *